US010308428B2

(12) United States Patent
DeCarr et al.

(10) Patent No.: US 10,308,428 B2
(45) Date of Patent: Jun. 4, 2019

(54) WASTE RECEPTACLES AND LIFT ROD ASSEMBLIES THEREFOR

(71) Applicant: Rubbermaid Commercial Products LLC, Winchester, VA (US)

(72) Inventors: Gary DeCarr, Fort Mill, SC (US); Jacob Connelly, Concord, NC (US)

(73) Assignee: Rubbermaid Commercial Products LLC, Atlanta, GA (US)

( * ) Notice: Subject to any disclaimer, the term of this patent is extended or adjusted under 35 U.S.C. 154(b) by 262 days.

(21) Appl. No.: 15/253,361

(22) Filed: Aug. 31, 2016

(65) Prior Publication Data

US 2017/0057742 A1 Mar. 2, 2017

Related U.S. Application Data

(60) Provisional application No. 62/213,190, filed on Sep. 2, 2015.

(51) Int. Cl.
*B65F 1/16* (2006.01)

(52) U.S. Cl.
CPC ..... *B65F 1/163* (2013.01); *B65F 2001/1661* (2013.01)

(58) Field of Classification Search
CPC ..... B65F 1/163; B65F 2001/1661
USPC ..... 220/262–264, 908
See application file for complete search history.

(56) References Cited

U.S. PATENT DOCUMENTS

| | | | | |
|---|---|---|---|---|
| 2,325,897 | A * | 8/1943 | Waltman | A47J 36/12 220/264 |
| 2,547,089 | A * | 4/1951 | Oberst | F23G 5/444 16/57 |
| 2,920,338 | A * | 1/1960 | Falk | E05C 17/30 16/49 |
| 4,877,226 | A * | 10/1989 | Taylor | F16F 5/00 267/196 |
| 4,972,966 | A | 11/1990 | Craft, Jr. | |
| D332,852 | S | 1/1993 | Delmerico | |
| 5,230,525 | A | 7/1993 | Delmerico et al. | |
| D566,365 | S | 4/2008 | Wentz et al. | |
| D566,370 | S | 4/2008 | Wentz | |
| D566,371 | S | 4/2008 | Wentz | |
| D581,615 | S | 11/2008 | Presnell et al. | |
| D581,622 | S | 11/2008 | Presnell et al. | |
| 2004/0206758 | A1* | 10/2004 | Lin | B65F 1/163 220/263 |
| 2009/0084788 | A1 | 4/2009 | Yang et al. | |

FOREIGN PATENT DOCUMENTS

| | | |
|---|---|---|
| CH | 676836 A5 | 5/1988 |
| DE | 20001431 U1 | 5/2000 |
| GB | 2323020 A | 9/1998 |

OTHER PUBLICATIONS

GB Application No. 1614839.7, Search Report, dated Oct. 27, 2016 (4 pages).

* cited by examiner

*Primary Examiner* — James N Smalley
(74) *Attorney, Agent, or Firm* — Eversheds Sutherland (US) LLP

(57) ABSTRACT

Lift rod assemblies for waste receptacles having pedal-operated lids are provided. Such lift rod assemblies can include a first end configured to couple to the pedal and a distal second end configured to couple to the lid, and a spring configured to dampen a force in excess of a predetermined force threshold applied to the pedal by the user and transferred to the elongated lift rod assembly. Waste receptacles including such lift rod assemblies are also provided.

10 Claims, 13 Drawing Sheets

WASTE RECEPTACLES AND LIFT ROD ASSEMBLIES THEREFOR

CROSS-REFERENCE TO RELATED APPLICATIONS

This application claims priority to U.S. Provisional Application No. 62/213,190, filed Sep. 2, 2015, which is incorporated by reference in its entirety.

TECHNICAL FIELD

The present application generally relates to waste receptacles, and, more specifically, to pedal-operated lift rod assemblies for opening the lid of waste receptacles.

BACKGROUND

Waste receptacles or trash cans having pedal-operated lid opening mechanisms, such as lift rods, are known to experience issues in response to aggressive usage. For example, users may step on the pedal with a downward force in excess of a maximum force threshold of the pedal-lift rod assembly. In such cases, this aggressive usage may result in failure of the lift rod, the lid, or both. For example, the lid may become detached from the lift rod or break.

SUMMARY

In one embodiment, a waste receptacle includes an enclosure including an enclosed base portion and at least one sidewall extending from the base portion, the at least one sidewall defining an open top portion to receive waste material therethrough; a lid hingedly coupled to the enclosure; a pedal pivotably coupled to the base portion, the pedal being pivotable from a first position to a second position upon application of a minimum required force to the pedal by a user; and an elongated lift rod assembly including: a first end coupled to the pedal and a distal second end coupled to the lid such that when the pedal is in the first position, the lid is disposed in a closed position abutting the open top portion of the base portion, and, when the pedal is in the second position, the lid is disposed at a predetermined maximum pedal-adjusted angle, and a spring configured to dampen a force in excess of a predetermined force threshold applied to the pedal by the user and transferred to the elongated lift rod assembly.

In another embodiment, an elongated lift rod assembly for a waste receptacle having a pedal-operated lid, includes a first end configured to couple to the pedal and a distal second end configured to couple to the lid and a spring configured to dampen a force in excess of a predetermined force threshold applied to the pedal by the user and transferred to the elongated lift rod assembly.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
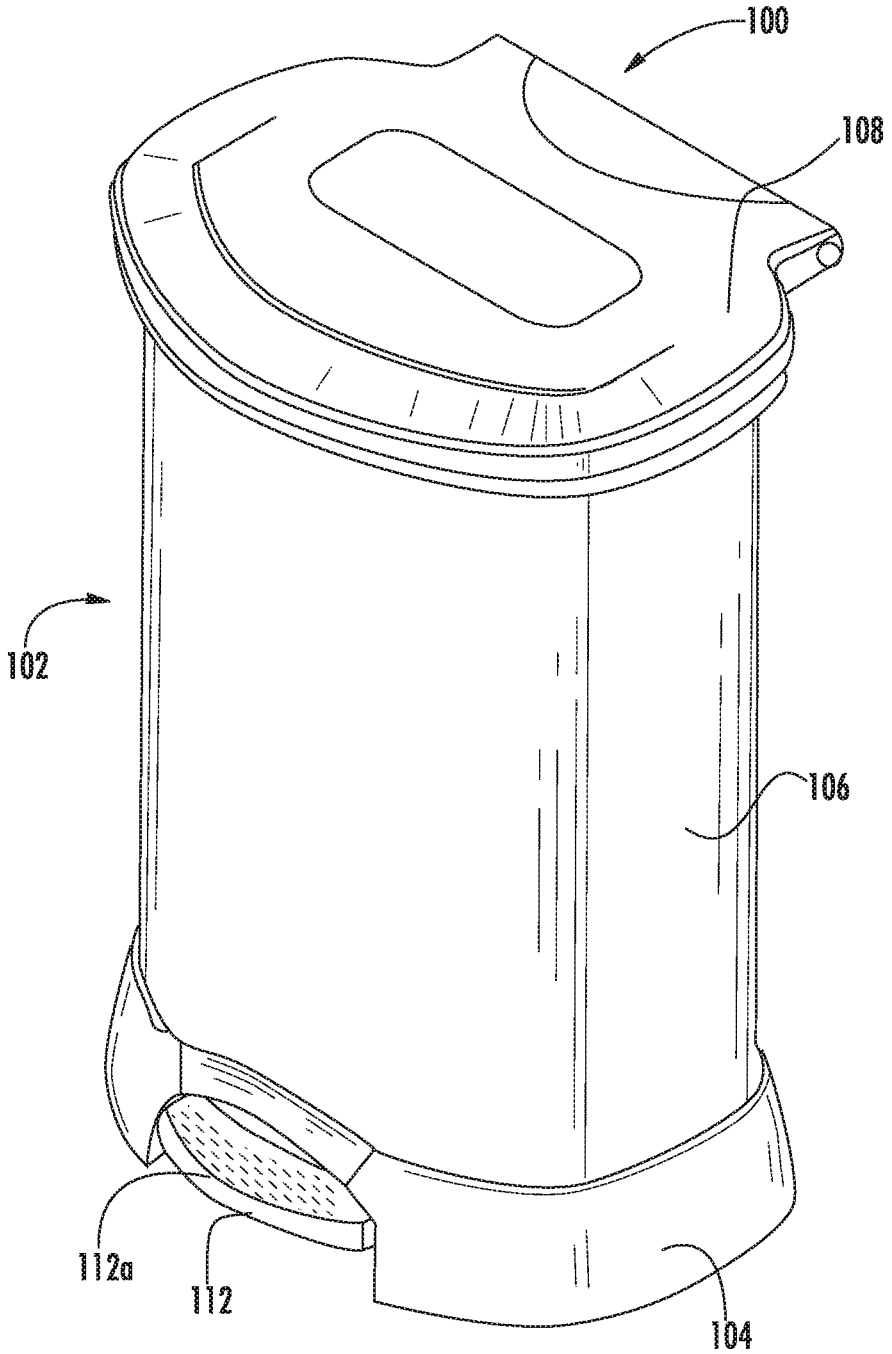
FIG. 1 is a perspective view of one embodiment of a waste receptacle, in accordance with the present disclosure.
Figure 2:
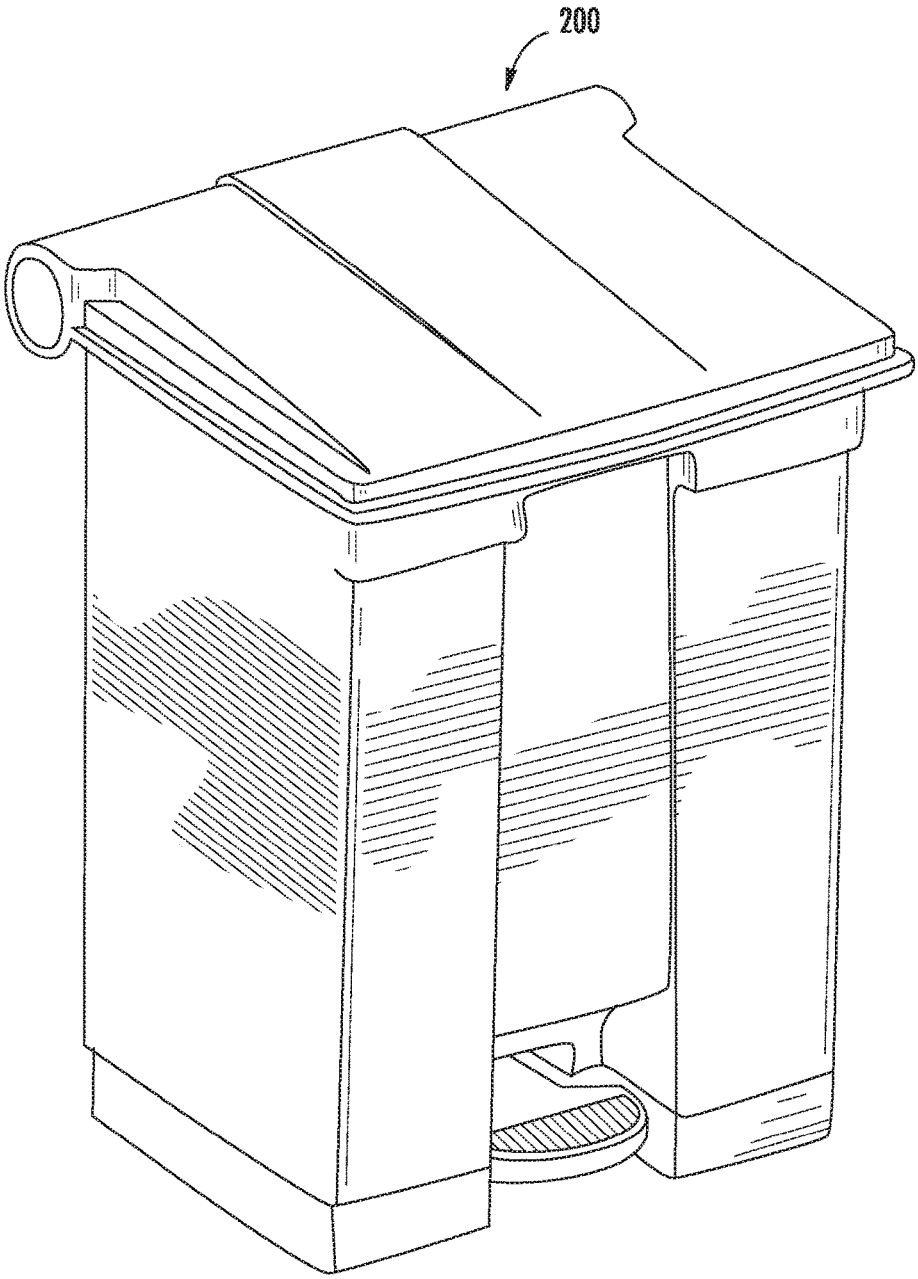
FIG. 2 is a perspective view of one embodiment of a waste receptacle, in accordance with the present disclosure.

Embodiments of the present disclosure provide an elongated lift rod assembly for a waste receptacle that can withstand increased forces associated with users opening the lid of the waste receptacle. In example embodiments, the elongated lift rod assembly is configured to dampen the force applied to the pedal by the user and passed through to the lid of the waste receptacle by way of the lift rod assembly, to prevent failure at the lid, the pedal, and/or the elongated lift rod assembly.

For example, as will be described in more detail herein, the elongated lift rod assembly may include one or more elongated lift rods that extend between and connect the pedal of the waste receptacle and the lid of the waste receptacle, such that when the pedal is in the first (or unactuated) position, the lid is disposed in a closed position, and, when the pedal is in the second (or actuated) position, the lid is disposed in an open position. That is, a user may open the lid of the waste receptacle by applying a downward force to the pedal in excess of a minimum force threshold of the lift rod assembly. In typical rigid lift rod assemblies, the maximum force threshold of the pedal-lift rod assembly may easily be exceeded by vigorous use, resulting in failure of the lid, lift rod assembly, and/or pedal. For example, the lid may become detached from the lift rod or break.

Embodiments of the elongated lift rod assemblies described herein, and waste receptacles containing such assemblies, can withstand increased forces associated with users opening the lid of the waste receptacle and prevent failure of the lid, lift rod assembly, and/or pedal as a result of excessive force applied to the pedal. In contrast to rigid lift rod assemblies, the presently described lift rod assemblies include a spring configured to dampen excessive force applied to the pedal by the user, to prevent failure at the lid and the lift rod assembly. Thus, the ability of a user to apply excess force to the lid of a waste receptacle by applying force to the pedal is substantially reduced. For example, waste receptacles containing the elongated lift rod assemblies described herein may allow the lid to be held close when the pedal is actuated, without damaging the lid, lift rod assembly, and/or pedal.

Example embodiments of waste receptacles and elongated lift rod assemblies are described in further detail below. As used herein, the term "about" means plus or minus 10 percent of the numerical value of the number with which it is being used.

Waste Receptacles

Waste receptacles including a spring-dampened elongated lift rod assembly are provided herein. Various suitable designs of waste receptacles (e.g., 100, 200, 300, 400, 500) having pedal-operated lids are known in the art, including those shown at FIGS. 1-5B. For example, the waste receptacle with a pedal-operated lid may be an indoor-style receptacle, a larger format receptacle, a wheeled receptacle, or any other suitable receptacle. One will recognize that various components of the waste receptacles having pedal-operated lids in the disclosures of U.S. Pat. Nos. 4,972,966; 5,230,525; D332,852; D581,615; and D581,622 can be utilized in conjunction with certain embodiments of the present disclosure. It should be understood that any suitable waste receptacle, pedal, and lid designs may be used in accordance with the present disclosure.

In example embodiments, as shown in FIG. 1, a waste receptacle 100 includes an enclosure 102 having an enclosed base portion 104 and at least one sidewall 106 extending from the base portion 104 to define an open top portion (not shown) to receive waste material therethrough. As used herein, the terms "enclosure" and "enclosed base portion" refer to the receptacle 100 having substantially continuous side and bottom walls to contain the waste material; however, it should be appreciated that the walls may include certain openings, such as drains, vents, or other suitable openings. In certain example embodiments, the enclosed base portion 104 forms the bottom of the waste receptacle 100. In certain example embodiments, as partially shown in FIGS. 5A and 5B, the at least one sidewall 506 includes a front wall 506*a*, a rear wall 506*b*, and two opposing sidewalls 506*c* and 506*d* (not shown). In certain example embodiments, the enclosure has a volume of from about 30 liters to about 100 liters. For example, the enclosure may have a volume of about 50 liters, about 68 liters, or about 90 liters.

Figure 3:
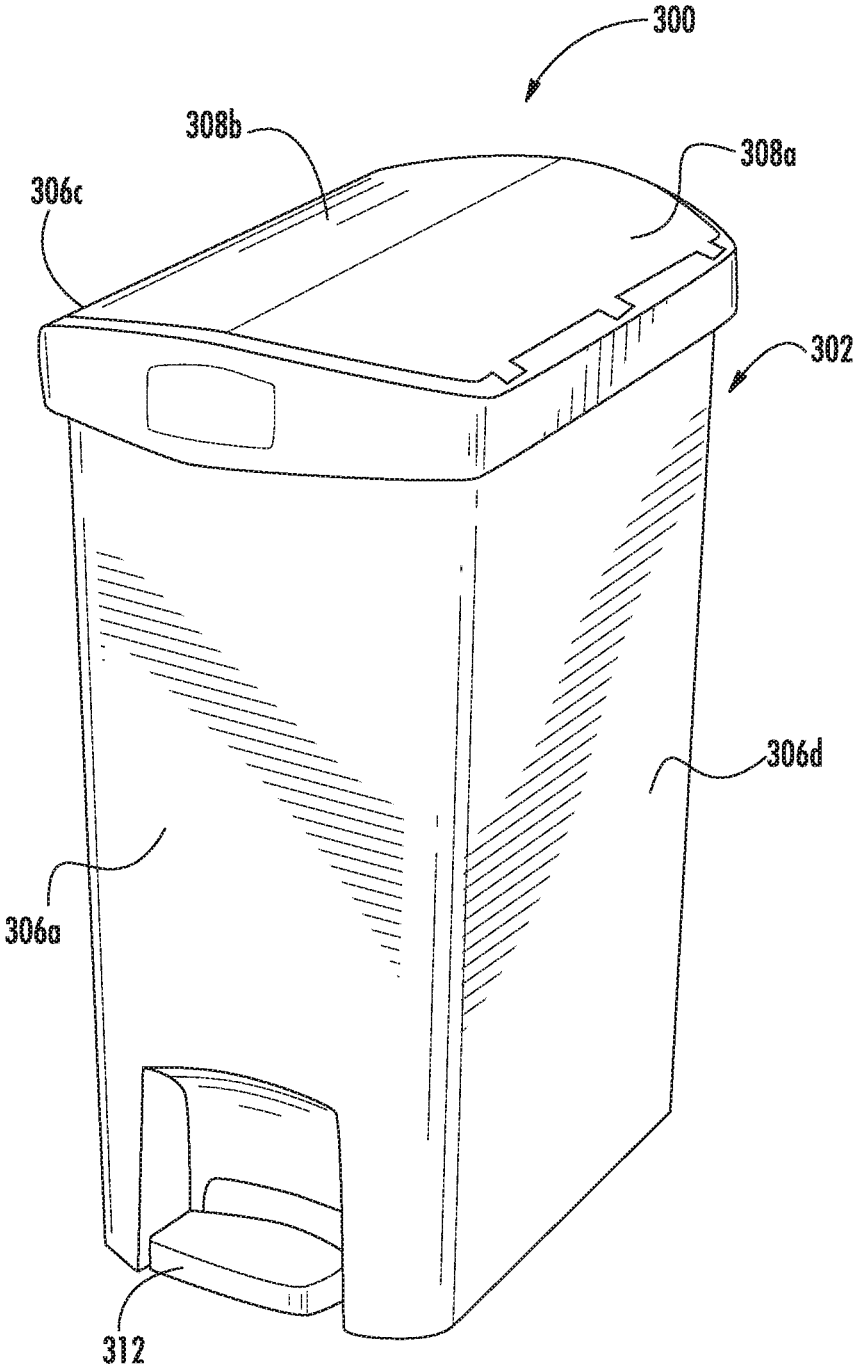
FIG. 3 is a perspective view of one embodiment of a waste receptacle, in accordance with the present disclosure.
Figure 5A:
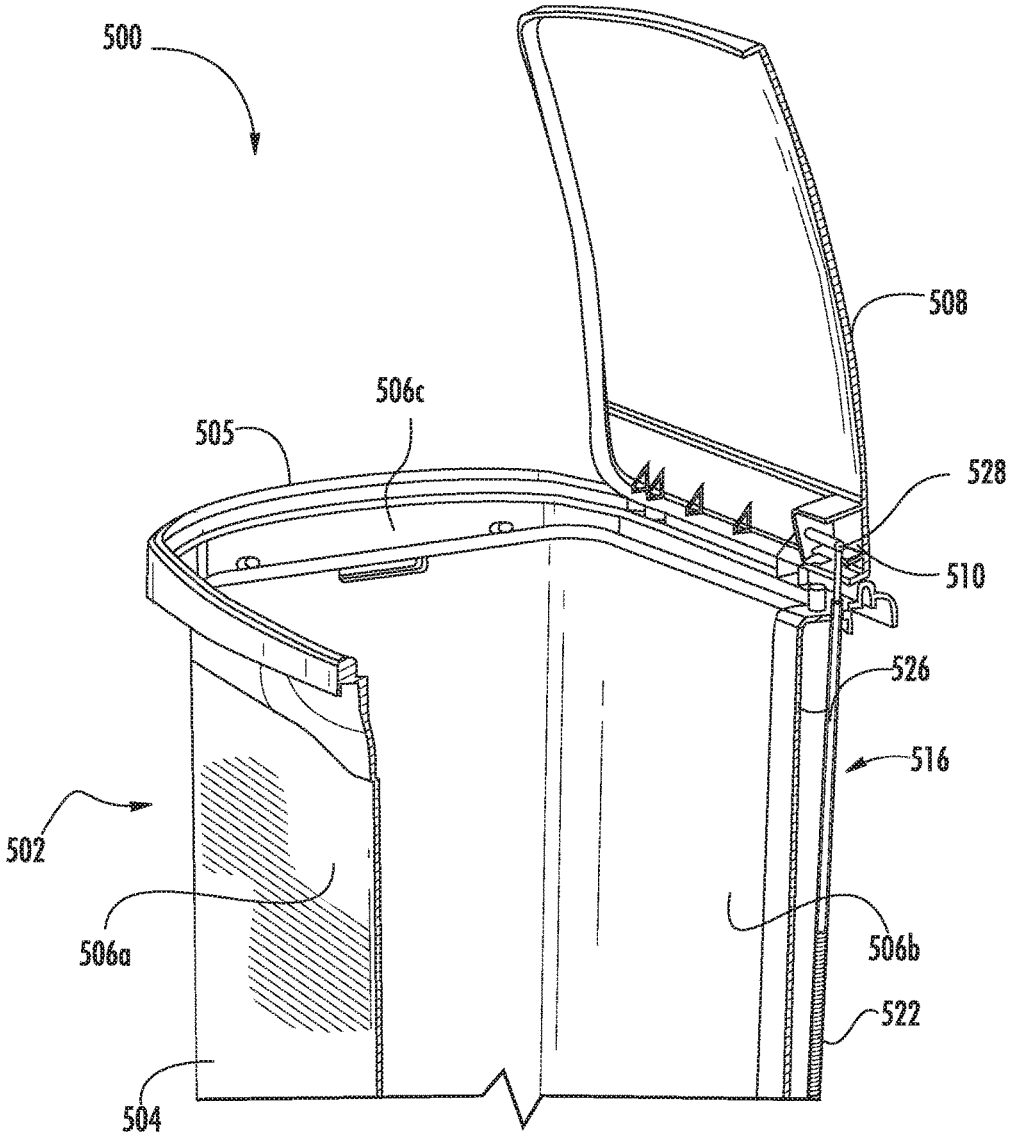
FIG. 5A is a cross-sectional perspective view of a waste receptacle having an elongated lift rod assembly, with the lid of the receptacle in an open position, in accordance with an embodiment of the present disclosure.
Figure 5B:
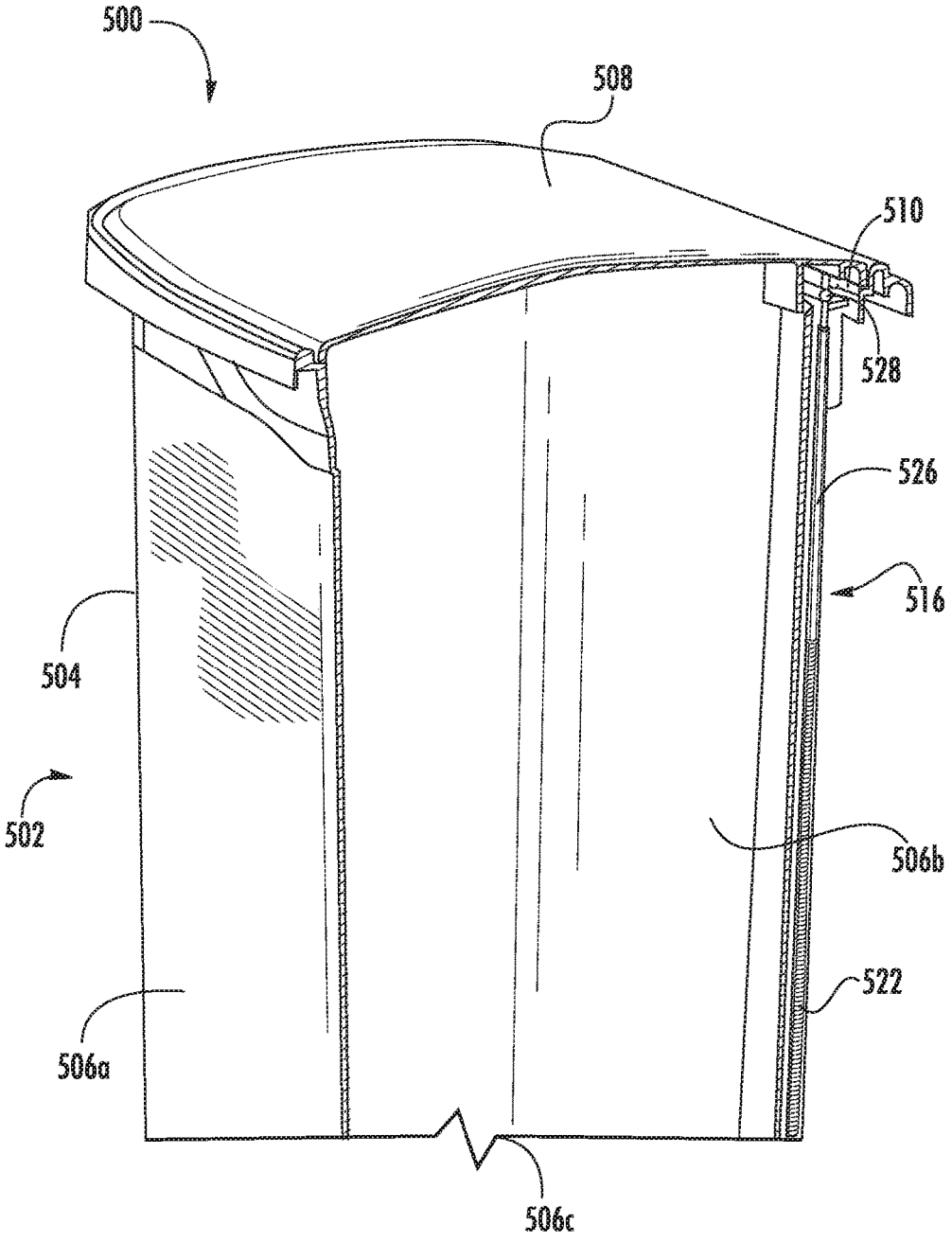
FIG. 5B is a cross-sectional perspective view of a waste receptacle having an elongated lift rod assembly, with the lid of the receptacle in a closed position, in accordance with an embodiment of the present disclosure.

In certain example embodiments, as shown in FIGS. 5A and 5B, the waste receptacle 500 also includes at least one lid 508 that is hingedly and rotatably coupled to the enclosure 502. For example, the lid 508 may be coupled to the enclosure 502 by any suitable means known in the art, such as is described in U.S. Pat. Nos. 4,972,966 and 5,230,525. For example, the lid 108 may be coupled to the enclosure 102 by mold-in snap hinges. As used herein, the term "coupled" is used broadly and refers to components being directly or indirectly in contact with one another via any suitable fastening, connection, or attachment mechanism. In one embodiment, the at least one lid 508 is coupled to the rear wall 506*b* of the enclosure 502 at a position adjacent or near the open top portion 505. In some example embodiments, as shown in FIG. 3, a waste receptacle 300 includes a pair of lids 308*a*, 308*b* that are hingedly coupled to the enclosure 302 at opposed sidewalls 306*c* and 306*d*.

Figure 4:
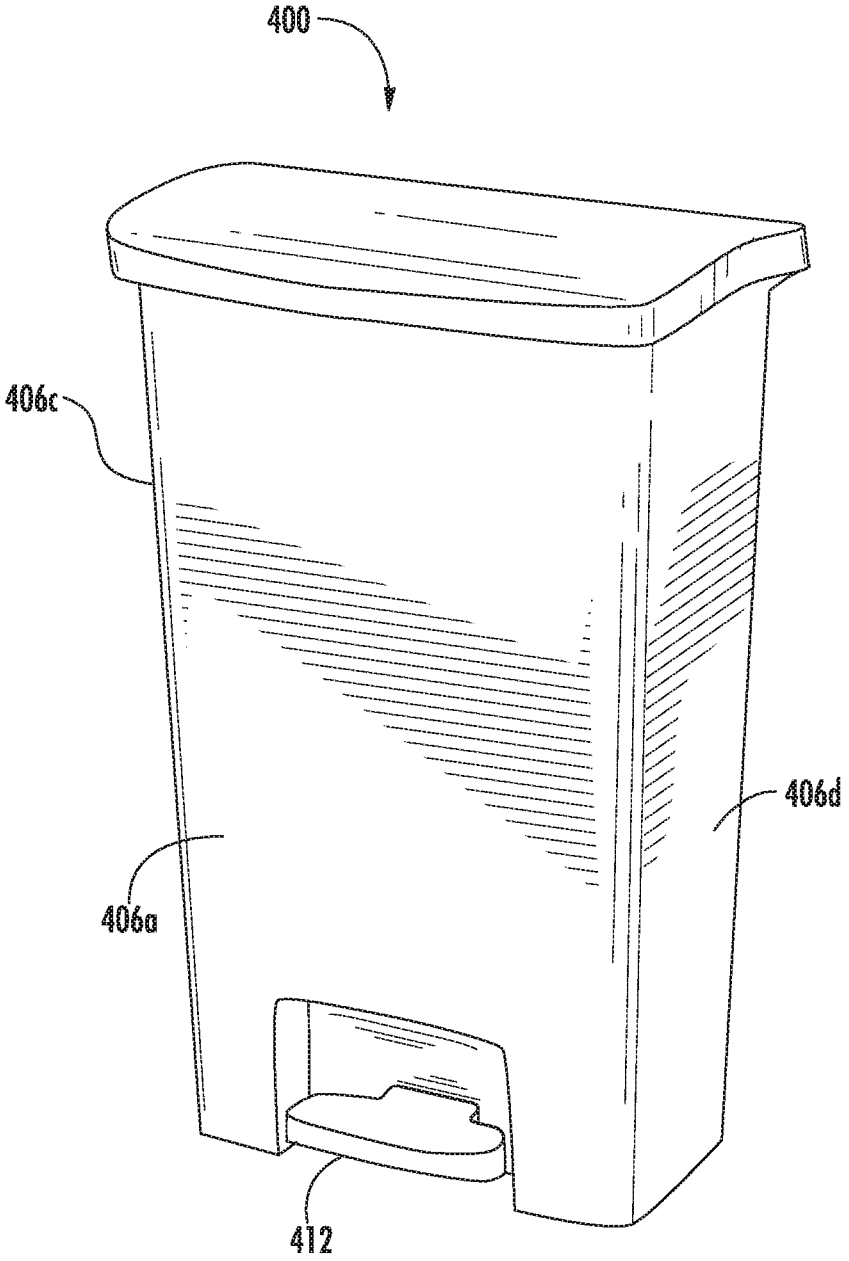
FIG. 4 is a perspective view of one embodiment of a waste receptacle, in accordance with the present disclosure.

In certain example embodiments, as shown in FIG. 1, the waste receptacle 100 also includes a pedal 112 having a first end 112*a* and a distal second end 112*b* (not shown). The pedal 112 is pivotably coupled to the base portion 104 and is pivotable from a first position to a second position. For example, the first position may be an unactuated or "at rest" position of the pedal 112, while the second position may be an actuated position achieved by a user applying at least a minimum required downward force on the first end 112*a* of the pedal 112 with his foot. As shown in FIG. 3, the pedal 312 may be disposed at the front wall 306*a* of the waste receptacle 300. For example, the front wall 306*a* may have a width that is less than the width of sidewalls 306*c*, 306*d*, such that the pedal 312 is provided in a wall having the smaller dimension, also known as an "end step" design. For example, as shown in FIG. 4, the front wall 406*a* may have a width that is greater than the width of the opposed sidewalls 406*c*, 406*d*, such that the pedal 412 is provided in a wall having a larger dimension, also known as a "front step" design.

In some example embodiments, the enclosed base portion 104 defines a channel extending from or substantially from a front side of the base portion 104 to an opposing rear side of the base portion 104 to accommodate at least a portion of the pedal 112 therein. In some example embodiments, the pedal 112 is coupled to a pedal axle that is coupled to a bottom surface of the enclosed base portion 104, such as by brackets or other suitable fasteners. In some example embodiments, the pedal axle is integral with and/or integrally formed with the pedal and extends longitudinally in a direction orthogonal to or substantially orthogonal to the longitudinal axis of the pedal 112. The pedal 112 may be coupled to the base portion 104 such that the pedal 112 is feely pivotable about a fulcrum defined by the pedal axle. In certain example embodiments, the pedal 112 is pivotable from the first position to the second position upon application of at least 5 pounds of downward force upon the first end 112*a* of the pedal 112 by a user.

In certain example embodiments, as shown in FIGS. 5A and 5B, the waste receptacle 500 further includes an elongated lift rod assembly 516. In example embodiments, the elongated lift rod assembly 516 includes a first end coupled to the pedal (not shown), a distal second end 528 coupled to the lid 508, and a spring 522 configured to dampen a force in excess of a predetermined force threshold applied to the pedal by the user and transferred to the elongated lift rod assembly. The predetermined force threshold may be any suitable force above the minimum required force to pivot the pedal from the first position to the second position. That is, the spring may be configured to dampen the force applied to the pedal by the user and passed through to the lid of the waste receptacle by way of the lift rod assembly, to prevent failure at the lid and the elongated lift rod assembly.

In certain example embodiments, the elongated lift rod assembly 516 is configured such that when the pedal is in the first position, the lid 508 is disposed in a closed position abutting the open top portion 505 defined by the one or more sidewalls 506*a-d* of the enclosure 502 (as shown in FIG. 5B), and, when the pedal is in the second position, the lid 508 is disposed at a predetermined maximum pedal-adjusted angle (as shown in FIG. 5A). As used herein, the term "closed position," when used with reference to the lid 508, refers to the lid 508 abutting the open top portion 505 of the enclosure 502. In some example embodiments, when in the closed position, the lid 508 lies in a plane perpendicular to the longitudinal axis of waste receptacle 500.

In one example, as shown in FIG. 1, when a user applies a downward force on the first end 112*a* and pivots the pedal 112 from the first to the second position, the second end (not shown) of the pedal 112 moves in a generally upward direction causing the elongated lift rod assembly (not shown) to correspondingly move in an upward direction to open the lid 108 up to the maximum pedal-adjusted angle. For example, as shown in FIG. 5A, when a user applies a downward force to pivot the pedal from the first to the second position, the second end of the pedal moves in a generally upward direction causing the second end 528 of the elongated lift rod assembly 516 to engage or otherwise enter a lid adjustment channel 510 to open the lid 508 up to the maximum pedal-adjusted angle. For example, the lift rod assembly 516 may move in a direction parallel to the longitudinal axis of the waste receptacle 500 (e.g., vertically upward) to move further into the lid adjustment channel 510 and open the lid 508.

As shown in FIGS. 5A and 5B, the lid 508 is rotatable from the closed position (FIG. 5B) to the predetermined maximum pedal-adjusted angle (FIG. 5A), in response to the pedal being pivoted from the first position to the second position. Thus, the lid 508 is disposed at the predetermined maximum pedal-adjusted angle when the pedal is in the second position. In some example embodiments, the predetermined maximum pedal-adjusted angle is about 90 degrees or less, measured relative the closed position. In some example embodiments, the predetermined maximum pedal-adjusted angle is from about 60 degrees to about 90 degrees, measured relative the closed position. In some example embodiments, the predetermined maximum pedal-adjusted angle is about 80 degrees, measured relative the closed position. In one example embodiment, application of downward force on the first end of the foot pedal to move the pedal to the second position opens the lid 508 to the predetermined maximum pedal-adjusted angle, for example, about 80 degrees. Once the lid 508 reaches the predetermined maximum pedal-adjusted angle, the lid adjustment channel 510 engaging the end 528 of the lift rod assembly 516 prevents the lid 508 from opening further.

Figure 6A:
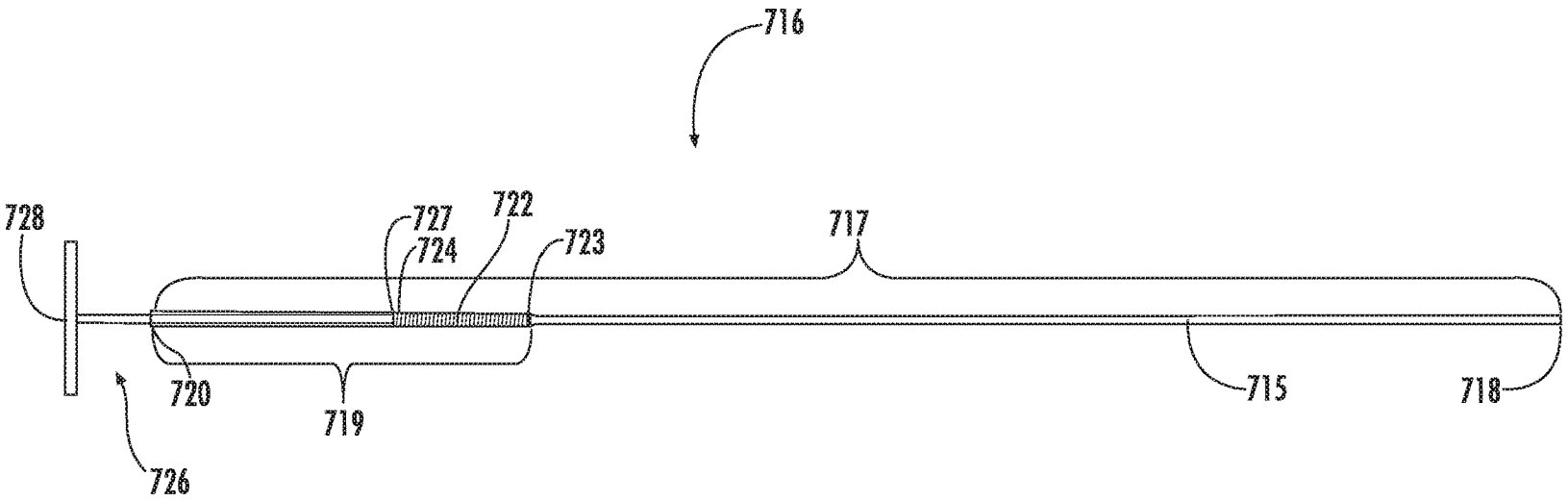
FIG. 6A is a plan view of an elongated lift rod assembly, in accordance with an embodiment of the present disclosure.
Figure 6B:
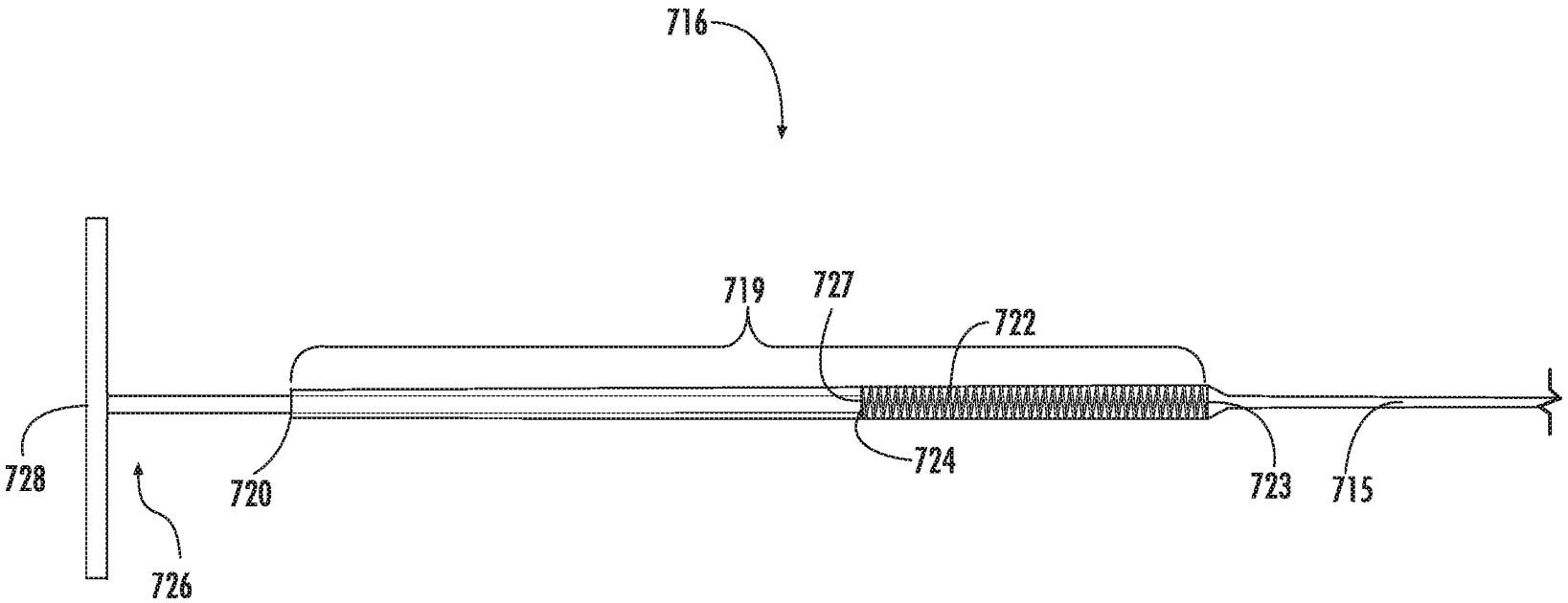
FIG. 6B is a partial plan view of the elongated lift rod assembly of FIG. 6A.

In certain example embodiments, as shown in FIGS. 6A and 6B, the elongated lift rod assembly 716 has a first end 718 configured to couple to the pedal (not shown) and a distal second end 728 configured to couple to the lid (not shown) of a waste receptacle. For example, the first end 718 may include an aperture in the elongated lift rod 717 that is configured to be coupled via a bolt and nut, screw, or rivet to a corresponding aperture in the second end of the pedal. In example embodiments, the lift rod engages the pedal via a snap feature, and this snap retention feature dually serves as the lower mounting pivot pin.

The second end 728 of the lift rod assembly 716 may be rigidly or permanently coupled to the lid of the waste receptacle. In certain example embodiments, as shown in FIG. 6A, the second end 728 is T-shaped. As used herein, the term "T-shaped" refers to the second end of the lift rod including a second rod member that is disposed perpendicularly or substantially perpendicularly to the longitudinal axis of the lift rod assembly. It will be appreciated that other suitable shapes and designs of the second end of the lift rod assembly may also be used.

Various configurations of elongated lift rod assemblies and springs are envisioned and the embodiments disclosed herein should be understood to represent example embodiments such that the disclosure is not limited to such disclosed embodiments. Rather, the disclosed lift rod assemblies can be modified to incorporate any number of variations, alterations, substitutions, or equivalent arrangements not described herein. The spring may be designed to have suitable dimensions and spring characteristics to provide the desired spring force to the elongated lift rod assembly.

In example embodiments, the lift rod assembly is configured to be coupled directly or indirectly to the pedal and the lid of a waste receptacle, such that upon pivoting of the pedal to the second position, the lift rod assembly generally correspondingly moves to open the lid. Specifically, upon application of a force sufficient to move the pedal into the second position (i.e., of at least the minimum required force), the elongated lift rod assembly moves in a generally upward direction. Thus, in example embodiments, the spring of the elongated lift rod assembly is configured to absorb excessive forces (e.g., forces in excess of a force threshold of the lift rod assembly) applied to the pedal, and thereby dampen the force applied to the lift rod to open the lid of the waste receptacle. In certain example embodiments, the spring is configured to dampen the force applied at the pedal such that the lid is rotated from the closed position to the maximum pedal-adjusted position at a substantially constant rate, upon application of at least the minimum required force in a generally downward direction by a user to the pedal.

In certain example embodiments, the waste receptacle further includes a damper mechanism (not shown) for controlling the rate of closure of the lid once the force applied to pivot the pedal into the second position is removed. Suitable damper mechanisms that may be used with the present disclosure are known in the art. For example, a damper may be utilized to control the top lid closing speed.

Elongated Lift Rod Assemblies

Elongated lift rod assemblies for waste receptacles having pedal-operated lids are also provided herein. For example, the presently described lift rod assemblies may be adapted to be integrated into waste receptacles having the pedal-operated lid. For example, the presently described lift rod assemblies may be retrofit into preexisting waste receptacle designs. That is, the lift rod assemblies of the present disclosure may be substituted for existing rigid lift rod assemblies in known waste receptacles. The elongated lift rod assemblies may include any features, or combination of features, described herein.

In certain example embodiments, an elongated lift rod assembly for a waste receptacle having a pedal-operated lid includes a first end configured to couple to the pedal and a distal second end configured to couple to the lid, and a spring configured to dampen a force in excess of a predetermined force threshold applied to the pedal by the user and transferred to the elongated lift rod assembly.

In example embodiments, as shown in FIGS. 6A-6B, the lift rod assembly 716 is configured to be coupled to the pedal and the lid of a waste receptacle, such that upon pivoting of the pedal to the second position, the lift rod assembly 716 generally correspondingly moves to open the lid. In certain example embodiments, as shown in FIGS. 6A and 6B, the elongated lift rod assembly 716 has a first end 718 configured to couple to the pedal (not shown) and a distal second end 728 configured to couple to the lid (not shown) of a waste receptacle. For example, the first end 718 may include an aperture in the elongated lift rod 717 that is configured to be coupled via a bolt and nut, screw, or rivet to a corresponding aperture in the second end of the pedal. In example embodiments, the lift rod engages the pedal via a snap feature, and this snap retention feature dually serves as the lower mounting pivot pin.

Figure 7A:
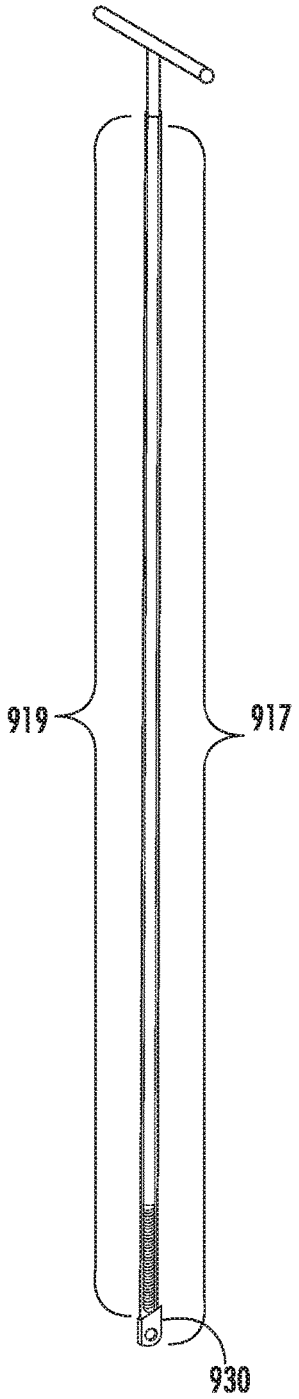
FIG. 7A is a perspective view of an elongated lift rod assembly, in accordance with an embodiment of the present disclosure.
Figure 7B:
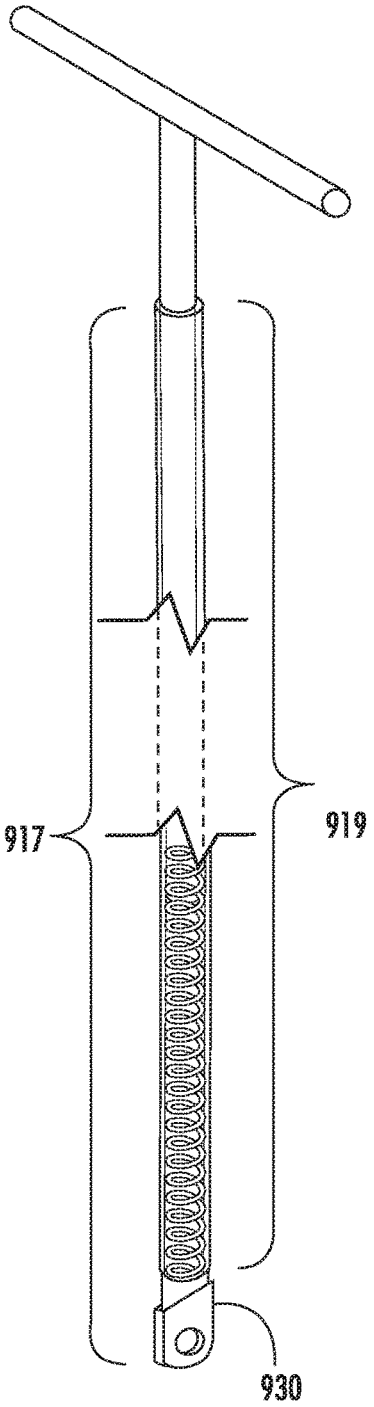
FIG. 7B is a partial perspective view of the elongated lift rod assembly of FIG. 7A.

For example, as shown in FIGS. 7A-7B, the elongated lift rod assembly may include a pedal coupling mechanism 930 that extends along less than 5 percent of the length of the elongated lift rod assembly. The pedal coupling mechanism 930 may include a threaded or unthreaded aperture or pair of apertures for receiving a coupling device (e.g., bolt, screw, rivet, cotter pin, clevis pin, hinge pin, clip, etc.) therethrough. For example, the pedal coupling mechanism 930 may be a flat, planar end of the elongated lift rod that is directly or indirectly coupled to the rod or integral therewith.

The second end 728 of the lift rod assembly 716 may be rigidly or permanently coupled to the lid of the waste receptacle. In certain example embodiments, as shown in FIG. 6A, the second end 728 is T-shaped. As used herein, the term "T-shaped" refers to the second end of the lift rod including a second rod member that is disposed perpendicularly or substantially perpendicularly to the longitudinal axis of the lift rod assembly. It will be appreciated that other suitable shapes and designs of the second end of the lift rod assembly may also be used.

The elongated lift rod assembly may include one or more suitable elongated lift rods that extend between and connect the pedal of the waste receptacle and the lid of the waste receptacle, such that when the pedal is in the first (or unactuated) position, the lid is disposed in a closed position, and, when the pedal is in the second (or actuated) position, the lid is disposed in an open position. For example, the elongated lift rods may be of any suitable design, material, and configuration, including solid and hollow rods.

A spring may be incorporated into or with the elongated lift rods so as to limit the force that is transmitted from the pedal to the lid upon application of a force to the pedal by the user. That is, the spring may be designed to dissipate excessive energy applied to the lift rod assembly, such as under abusive conditions. In example embodiments, the elongated lift rod assembly includes one or more torsion springs, tension springs, leaf springs, compression springs, other suitable springs, or combinations thereof. The spring may be incorporated into or with the one or more elongated lift rods in any suitable fashion, some examples of which are detailed herein. Moreover, the spring may be designed to have suitable dimensions and spring characteristics to provide the desired spring force to the elongated lift rod assembly.

Torsion Spring Embodiments

Figure 9:
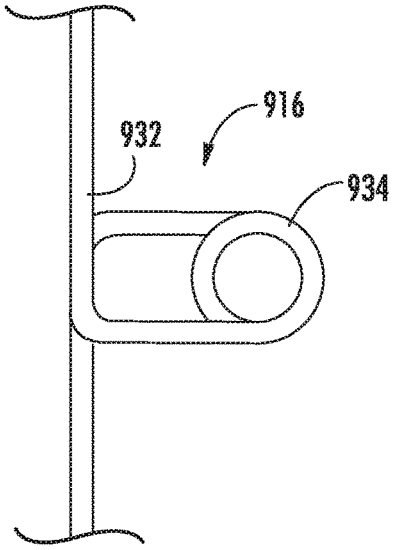
FIG. 9 is a partial plan view of an elongated lift rod assembly, in accordance with an embodiment of the present disclosure.

In example embodiments, as shown in FIG. 9, the elongated lift rod assembly 916 includes an elongated lift rod 932 and a torsion spring 934 configured to dampen a force in excess of a predetermined force threshold applied to the pedal by the user and transferred to the elongated lift rod assembly. In some example embodiments, as shown in FIG. 9, the elongated lift rod assembly 916 includes an elongated lift rod 932 having an integral torsion spring 934. That is, in some embodiments, the elongated lift rod assembly 916 includes a single elongated lift rod 932 having the torsion spring 934 formed therein.

Tension Spring Embodiments

Figure 10:
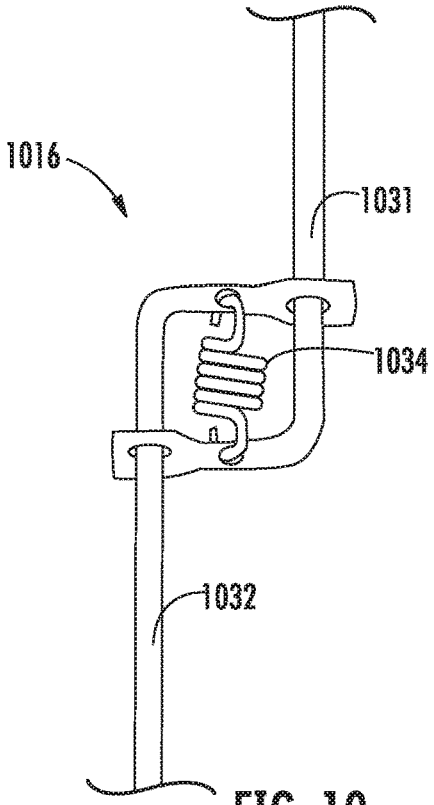
FIG. 10 is a partial plan view of an elongated lift rod assembly, in accordance with an embodiment of the present disclosure.
Figure 11:
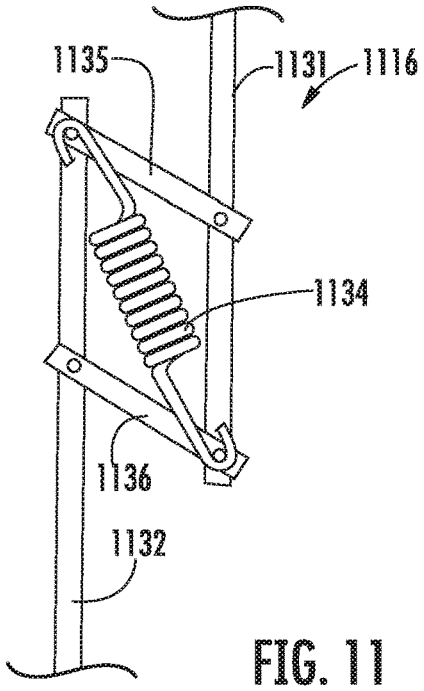
FIG. 11 is a partial plan view of an elongated lift rod assembly, in accordance with an embodiment of the present disclosure.

In example embodiments, as shown in FIGS. 10 and 11, the elongated lift rod assembly includes a pair of lift rods coupled via a connection that includes a tension spring. In some example embodiments, as shown in FIG. 10, the elongated lift rod assembly 1016 includes substantially parallel lift rods 1031, 1032 that are coupled to one another via transverse attachment portions having apertures therein to receive the other lift rod, 1031, 1032. A tension spring 1034 is attached to the transverse attachments portions, such that tension spring 1034 is configured to dampen a force in excess of a predetermined force threshold applied to the pedal by the user and transferred to the elongated lift rod assembly 1016.

In some example embodiments, as shown in FIG. 11, the elongated lift rod assembly 1116 includes substantially parallel lift rods 1131, 1132 that are coupled to one another via transverse attachment rods 1135, 1135 that are each connected to both of the parallel lift rods 1131, 1132 via suitable attachment means (e.g., screw, bolt and nut, or rivet), such that the transverse attachment rods 1135, 1135 are movable between a position that is perpendicular to the substantially parallel lift rods 1131, 1132 and a position that is nearly parallel to the substantially parallel lift rods 1131, 1132. A tension spring 1134 is attached to the transverse attachment rods 1135, 1135, such that the tension spring 1134 is configured to dampen a force in excess of a predetermined force threshold applied to the pedal by the user and transferred to the elongated lift rod assembly 1116.

Leaf Spring Embodiments

Figure 14:
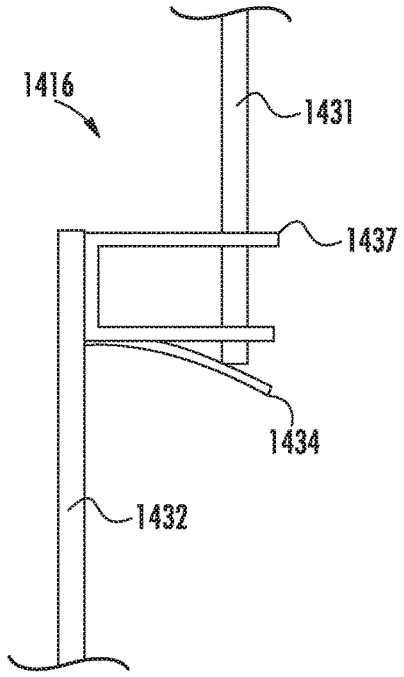
FIG. 14 is a partial plan view of an elongated lift rod assembly, in accordance with an embodiment of the present disclosure.

In example embodiments, as shown at FIG. 14, the elongated lift rod assembly 1416 includes a pair of lift rods 1431, 1432 coupled via a connection including a leaf spring. In some example embodiments, the lift rods 1431, 1432 are substantially parallel and are coupled to one another via a guide bracket 1437 that is rigidly attached to one lift rod 1432 and provides a channel or aperture in which the second lift rod 1431 is permitted to move or slide. The elongated lift rod assembly 1416 contains a leaf spring 1434 that is rigidly connected to the first lift rod 1432 and/or to the guide bracket 1437 and is in communication with an end of the second lift rod 1434, such that the leaf spring 1434 is configured to dampen a force in excess of a predetermined force threshold applied to the pedal by the user and transferred to the elongated lift rod assembly 1416.

Compression Spring Embodiments

In example embodiments, as shown at FIGS. 6A-6B, 12, and 13, the elongated lift rod assembly includes a pair of parallel lift rods coupled via a connection that includes a compression spring.

In example embodiments, as shown in FIGS. 6A and 6B, the elongated lift rod 717 at least partially includes a tubular chamber 719 that defines and extends from the second end 720 of the elongated lift rod 717. As used herein, the term "tubular chamber" refers to a tube-like member having an inner surface defining a passageway and an opposed outer surface. The tubular chamber 719 may have any suitable cross-sectional shape (e.g., circular, rectangular, hexagonal, elliptical, etc.) and may have any suitable length. For example, the tubular chamber may be a hollow steel tube having an outer diameter of from about 4.5 mm to about 20.5 mm, and having an inner diameter of from about 4.0 mm to about 20.0 mm, other suitable extension chamber designs and sizes may be used. In one example embodiment, the outer diameter of the tubular chamber is about 7 mm and the inner diameter is about 6.5 mm.

In example embodiments, as shown in FIGS. 6A and 6B, an elongated lift rod assembly 716 includes an elongated lift rod 717 having a first end 718 configured to couple to the pedal and a distal second end 720.

In some example embodiments, as shown in FIGS. 7A and 7B, the tubular chamber 919 is substantially coextensive with the elongated lift rod 917. That is, the elongated lift rod 917 is substantially formed by the tubular chamber 919. As used herein, the terms "substantially coextensive," "substantially formed by," and similar terms refer to at least 95 percent of the length of the elongated lift rod 917 being the tubular chamber 919. For example, the elongated lift rod 917 may include a pedal coupling mechanism 930 distinct from the tubular chamber 919, and that extends along less than 5 percent of the length of the elongated lift rod 917. The pedal coupling mechanism 930 may include a threaded or unthreaded aperture or pair of apertures for receiving a coupling device (e.g., bolt, screw, rivet, cotter pin, clevis pin, hinge pin, clip, etc.) therethrough. For example, the pedal coupling mechanism 930 may be a flat, planar end of the elongated lift rod that is directly or indirectly coupled to the rod or integral therewith.

In other example embodiments, as shown in FIGS. 6A and 6B (which is an enlarged partial view of FIG. 6A), the tubular chamber 719 is disposed at a distance from the first end 718 of the elongated lift rod 717. That is, the elongated lift rod 717 is not substantially coextensive with the tubular chamber 719. For example, the tubular chamber 719 may be disposed between the second end of the elongated lift rod 720 and a longitudinal midpoint of the elongated lift rod 717. For example, the tubular chamber 719 may be disposed between the first end 718 of the elongated lift rod 717 and a longitudinal midpoint of the elongated lift rod 717. The tubular chamber 719 may be disposed at any suitable distance from the first end 718 of the elongated lift rod 717 and may have any suitable length. In such embodiments, as shown in FIG. 6A, the elongated lift rod 717 includes an extension lift rod 715 that forms all or a portion of the first end 718 of the elongated lift rod 717 and is coupled to the first end 723 of the tubular chamber 719. For example, the extension lift rod 717 may be integrally formed with or coupled to (e.g., welded or otherwise attached to) the tubular chamber 719. For example, the extension lift rod 717 may be a hollow steel tube having an outer diameter of from about 4.5 mm to about 20.5 mm, and having an inner diameter of from about 4 mm to about 20 mm, although solid rods, and other suitable extension lift rod designs and sizes may be used. In one example embodiment, the extension lift rod has an inner diameter of about 6.5 mm and an outer diameter of about 7 mm.

In example embodiments, as shown in FIGS. 6A and 6B, the elongated lift rod assembly 716 also includes a compression spring 722 disposed within the tubular chamber 719 and having a first end 723 and a distal second end 724. The compression spring 722 may be any suitable compression spring known to those in the art. For example, the compression spring 722 may be designed to have suitable dimensions and spring characteristics to fit within the tubular chamber 719 and to provide the desired spring force.

Figure 8B:
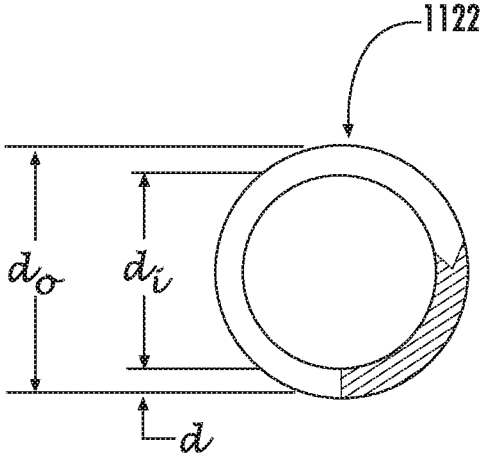
FIG. 8B is an end view of the compression spring of FIG. 8A.
Figure 8A:
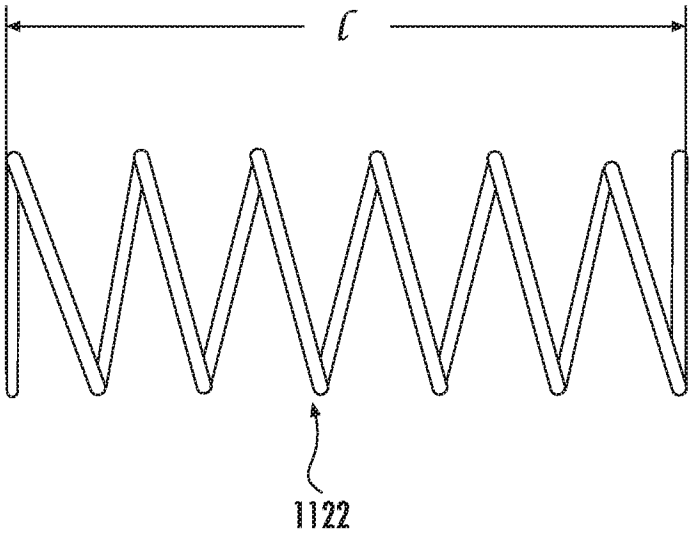
FIG. 8A is a perspective view of a compression spring in its uncompressed position, in accordance with an embodiment of the present disclosure.

In some example embodiments, the compression spring 722 has a free, or uncompressed, length that is less than the length of the tubular chamber 719. For example, as shown in FIG. 8A, the compression spring 1122 may have a free length (l) of from about 2 inches to about 5 inches, of from about 3 inches to about 4 inches, or of about 3.6 inches. For example, the compression spring 1122 may have a solid length of from about 0.5 inch to about 3 inches, of from about 1 inch to about 2 inches, or of about 1.2 inches. For example, as shown in FIG. 8B, the compression spring 1122 may have an inner diameter ($d_i$) defining a passageway of from about 0.05 inch to about 0.25 inch, of from about 0.1 inch to about 0.2 inch, or of about 0.18 inch. For example, the compression spring 1122 may have an outer diameter ($d_o$) of from about 0.1 inch to about 0.4 inch, of from about 0.2 inch to about 0.3 inch, or of about 0.25 inches. For example, the compression spring 1122 may be formed of a single piece of wire wound into a plurality of wire coils, with the wire having a diameter (d) of from about 0.01 inch to about 0.06 inch, of from about 0.025 inch to about 0.045 inch, or of about 0.035 inch. For example, the wire forming the compression spring 1122 may wound into about 20 to about 50 wire coils, from about 30 to about 40 wire coils, or about 35 coils. For example, the compression spring 1122 may have a spring rate of from about 3 pounds/inch of compression to about 10 pounds/inch of compression, of from about 5 pounds/inch of compression to about 8 pounds/inch of compression, or of about 6 pounds/inch of compression. For example, the compression spring 1122 may be formed of steel or other suitable materials. For example, the compression spring 1122 may have closed ends.

In example embodiments, the elongated lift rod assembly 716 further includes a stub lift rod 726 having a first end 727 and a distal second end 728 (which forms the second end of the lift rod assembly 716). The first end 727 of the stub lift rod 726 abuts the second end 724 of the compression spring 722 within the tubular chamber 719. Thus, the stub lift rod 726 may be slideably insertable into and at least partially disposed within the tubular chamber 719. For example, the stub lift rod 726 may be slideably disposed within the tubular chamber 719. The portion of the stub lift rod 726 that is slideably inserted into the tubular chamber 719 may have a cross-sectional shape that is the same or substantially the same as the cross-sectional shape of the tubular chamber 719. The complimentary shapes of at least the portion of the stub lift rod 726 and the tubular chamber 719 may prevent or substantially limit rotation of the stub lift rod 726 when at least a portion is inserted into the tubular chamber 719. In example embodiments, the portion of the stub lift rod 726 that is slideably inserted into the tubular chamber 719 may extend in a first longitudinal direction and the second end 728 of the stub lift rod 726 may extend in a second longitudinal direction that is orthogonal or substantially orthogonal to the first longitudinal direction to generally form a "T" shape. The second end 728 of the stub lift rod 726 may be configured to couple to the lid (not shown) of a waste receptacle. For example, as shown in FIGS. 5A and 5B, the second end 528 of the stub lift rod 526 (which forms the second end of the lift rod assembly 516) may be rigidly or permanently coupled to the lid 508.

In certain example embodiments, a suitable lubricant is provided within the tubular chamber 719 to lubricate compression of the spring 722 and/or sliding of the stub lift rod 726 within the tubular chamber 719. For example, the stub lift rod may be a solid steel shaft having an outer diameter of from about 3.5 mm to about 19.95 mm, or of from about 6.25 mm to about 6.45 mm, although hollow rods and other suitable stub lift rod designs and sizes may be used.

In some example embodiments, the tubular chamber 719 has an inner diameter defining a passageway and at least a portion of the first end 727 of the stub lift rod 726 includes an outer surface having an outer diameter, wherein the outer diameter of the portion of the stub lift rod 726 is less than the inner diameter of the tubular chamber 719, to facilitate sliding movement of the first end 727 of the stub lift rod 726 within the tubular chamber 719. In certain example embodiments, the outer diameter of at least a portion of the first end 727 of the stub lift rod 726 is greater than the inner diameter of the compression spring 722, such that the stub lift rod 726 cannot enter the passageway defined by the inner diameter of the compression spring 722. In some example embodiments, the compression spring is coupled to the stub lift rod.

In example embodiments, as shown in FIG. 6A, the stub lift rod assembly 716 is configured to be coupled directly or indirectly to the pedal and the lid of a waste receptacle, such that upon pivoting of the pedal to the second position, the lift rod assembly 716 generally correspondingly moves to open the lid. Specifically, upon application of a force sufficient to move the pedal into the second position (i.e., of at least the minimum required force), the elongated lift rod 717 moves in a generally upward direction, such that the stub lift rod 726 that is at least partially disposed in the tubular chamber 719 and abutting the compression spring 722 therein (i.e., the first end 727 of the stub lift rod 726 abuts the second end 724 of the compression spring 722 within the tubular chamber 719) correspondingly moves in a generally upward direction. Thus, in example embodiments, the compression spring 722 is configured to absorb excessive forces (e.g., forces in excess of a maximum force threshold of the pedal-lift rod assembly) applied to the pedal, and thereby dampen the force applied to the stub lift rod 726 to open the lid of the waste receptacle. In certain example embodiments, the compression spring 722 is configured to dampen the force applied at the pedal to the stub lift rod 726 such that the lid is rotated from the closed position to the maximum pedal-adjusted position at a substantially constant rate, upon application of at least the minimum required force in a generally downward direction by a user to the pedal.

For example, as shown in FIG. 5A, when a user applies a downward force to pivot the pedal from the first to the second position, the second end of the pedal moves in a generally upward direction causing the second end 528 of the stub lift rod 526 of the elongated lift rod assembly 516 to engage or otherwise enter a lid adjustment channel 510 to open the lid 508 up to the maximum pedal-adjusted angle. For example, the lift rod assembly 516 may move in a direction parallel to the longitudinal axis of the waste receptacle 500 (e.g., vertically upward) to move further into the lid adjustment channel 510 and open the lid 508.

In certain example embodiments, as shown in FIG. 5A, the second end 528 of the stub lift rod 526 is T-shaped. As used herein, the term "T-shaped" refers to the second end 528 of the stub lift rod 526 including a second rod member that is disposed perpendicularly or substantially perpendicularly to the longitudinal axis of the stub lift rod 526. It will be appreciated that other suitable shapes and designs of the second end of the stub lift rod 526 may also be used.

It should be appreciated that while embodiments of the present disclosure have described the waste receptacle with respect to the elongated lift rod being coupled to the pedal and the stub lift rod being coupled to the lid, the opposite configuration is also intended to fall within the scope of the present disclosure. For example, in certain embodiments, the elongated lift rod is configured to couple to the lid of a waste receptacle while the stub lift rod is configured to couple to the pedal of a waste receptacle.

Figure 12:
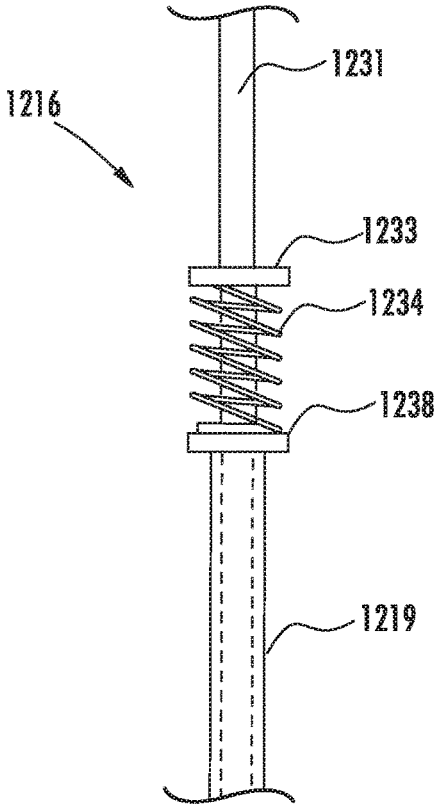
FIG. 12 is a partial plan view of an elongated lift rod assembly, in accordance with an embodiment of the present disclosure.

In some example embodiments, as shown in FIG. 12, the elongated lift rod assembly 1216 includes a pair of parallel lift rods 1231, 1219 coupled via a connection that includes a compression spring. Lift rod 1219 includes a tubular chamber that receives an end of lift rod 1231. A compression spring 1234 is disposed around the lift rod 1231 and is contained by at least one flange, or retainer, 1233, 1238, which restricts the longitudinal movement of the compression spring along the lift rod 1231, such that the compression spring 1234 is configured to dampen a force in excess of a predetermined force threshold applied to the pedal by the user and transferred to the elongated lift rod assembly 1216.

Figure 13:
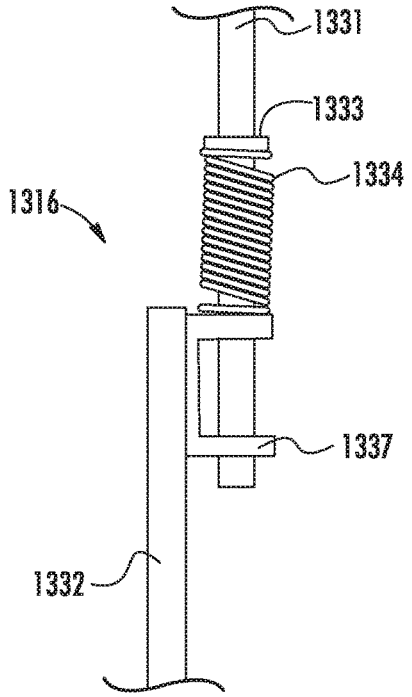
FIG. 13 is a partial plan view of an elongated lift rod assembly, in accordance with an embodiment of the present disclosure.

In some example embodiments, as shown in FIG. 13, the elongated lift rod assembly 1316 includes a pair of parallel lift rods 1331, 1332 coupled via a connection that includes a compression spring 1334. In some example embodiments, the lift rods 1331, 1332 are substantially parallel and are coupled to one another via a guide bracket 1337 that is rigidly attached to one lift rod 1332 and provides a channel or aperture in which the second lift rod 1331 is permitted to move or slide. The elongated lift rod assembly 1316 contains a compression spring 1334 that is disposed about the second lift rod 1434 and is contained by at least one flange, or retainer, 1333 which restricts the longitudinal movement of the compression spring along the lift rod 1331, such that the compression spring 1334 is configured to dampen a force in excess of a predetermined force threshold applied to the pedal by the user and transferred to the elongated lift rod assembly 1316.

The elongated lift rod assemblies described herein can withstand increased forces associated with users opening the lid of the waste receptacle and prevent failure of the lid, lift rod assembly, and/or pedal as a result of excessive force applied to the pedal. In contrast to rigid lift rod assemblies, the presently described lift rod assemblies include a spring configured to dampen the downward force applied to the pedal by the user, to prevent failure at the lid and the lift rod assembly. Thus, the ability of a user to apply excess force to the lid of a waste receptacle by applying force to the pedal is substantially reduced.

Additionally, the presently disclosed lift rod assemblies reduce the noise associated with operation of the pedal-driven lid opening mechanism, by preventing the lift rod assembly from advancing too forcefully into the lid and preventing the lid from rotating too forcefully into a wall or other features or furniture adjacent the waste receptacle. Moreover, the present lift rod assembly design provides improved strength compared to rigid lift rod designs, providing less bending of the lift rod assembly, which allows the lid to be opened to the maximum opening angle and reduces noise associated with the lift rod hitting the exterior of the waste receptacle during operation.

While the disclosure has been described with reference to a number of example embodiments, it will be understood by those skilled in the art that the disclosure is not limited to such disclosed embodiments. Rather, the disclosed embodiments can be modified to incorporate any number of variations, alterations, substitutions, or equivalent arrangements not described herein, but which are commensurate with the scope of the disclosure.

The claimed disclosure is:

1. A waste receptacle, comprising:

an enclosure comprising an enclosed base portion and at least one sidewall extending from the base portion, the at least one sidewall defining an open top portion to receive waste material therethrough;

a lid hingedly coupled to the enclosure;

a pedal pivotably coupled to the base portion, the pedal being pivotable from a first position to a second position upon application of a minimum required force to the pedal by a user; and an elongated lift rod assembly comprising:

a first end coupled to the pedal and a distal second end coupled to the lid such that when the pedal is in the first position, the lid is disposed in a closed position abutting the open top portion of the base portion, and, when the pedal is in the second position, the lid is disposed at a predetermined maximum pedal-adjusted angle;

an elongated lift rod at least partially comprising a tubular chamber;

a compression spring configured to dampen a force in excess of a predetermined force threshold applied to the pedal by the user and transferred to the elongated lift rod assembly, the compression spring being disposed within the tubular chamber and comprising a first end and a distal second end; and a stub lift rod comprising a first end abutting the second end of the compression spring within the tubular chamber.

2. The waste receptacle of claim 1, wherein the predetermined maximum pedal-adjusted angle is from about 60 degrees to about 90 degrees, measured relative the closed position.

3. The waste receptacle of claim 1, wherein the tubular chamber is substantially coextensive with the elongated lift rod.

4. The waste receptacle of claim 1, wherein the tubular chamber is disposed at a distance from the first end of the elongated lift rod assembly.

5. An elongated lift rod assembly for a waste receptacle having a pedal-operated lid, the elongated lift rod assembly comprising:

a first end configured to couple to the pedal and a distal second end configured to couple to the lid;

a compression spring configured to dampen a force in excess of a predetermined force threshold applied to the pedal by the user and transferred to the elongated lift rod assembly; and a pair of lift rods coupled via a connection comprising the compression spring, wherein a first of the pair of lift rods comprises an elongated lift rod at least partially comprising a tubular chamber, wherein the compression spring is disposed within the tubular chamber and comprises a first end and a distal second end, wherein a second of the pair of lift rods comprises a stub lift rod comprising a first end and a distal second end, the first end of the stub lift rod abutting the second end of the compression spring within the tubular chamber.

6. The elongated lift rod assembly of claim 5, wherein:

the tubular chamber has an inner diameter defining a passageway, at least a portion of the first end of the stub lift rod comprises an outer surface having an outer diameter, and the outer diameter of the at least a portion of the stub lift rod is less than the inner diameter of the tubular chamber.

7. The elongated lift rod assembly of claim 6, wherein:

the compression spring has an inner diameter defining a passageway, and the outer diameter of the at least a portion of the first end of the stub lift rod is greater than the inner diameter of the compression spring.

8. The elongated lift rod assembly of claim 5, wherein the tubular chamber is substantially coextensive with the elongated lift rod.

9. The elongated lift rod assembly of claim 5, wherein the tubular chamber is disposed at a distance from the first end of the elongated lift rod assembly.

10. The elongated lift rod assembly of claim 5, wherein the elongated lift rod assembly is adapted to be integrated into existing waste receptacles having the pedal-operated lid.

* * * * *